US006437492B1

(12) United States Patent
Geissinger et al.

(10) Patent No.: US 6,437,492 B1
(45) Date of Patent: Aug. 20, 2002

(54) CERAMIC SHEATHED-TYPE GLOW PLUG

(75) Inventors: Albrecht Geissinger, Muehlacker; Gert Lindemann, Lichtenstein; Christoph Haluschka, Klingenberg; Thomas Nething, Leonberg; Wolfgang Dressler, Vaihingen/Enz; Friederike Lindner, Gerlingen; Horst Boeder, Sindelfingen; Matthias Rowek, Goeppingen; Wolfgang Otterbach, Stuttgart; Christoph Kern, Aspach, all of (DE)

(73) Assignee: Robert Bosch GmbH, Stuttgart (DE)

( * ) Notice: Subject to any disclaimer, the term of this patent is extended or adjusted under 35 U.S.C. 154(b) by 68 days.

(21) Appl. No.: 09/555,333

(22) PCT Filed: Sep. 10, 1999

(86) PCT No.: PCT/DE99/02877

§ 371 (c)(1),
(2), (4) Date: Jul. 20, 2000

(87) PCT Pub. No.: WO00/19148

PCT Pub. Date: Apr. 6, 2000

(30) Foreign Application Priority Data

Sep. 28, 1998 (DE) ..... 198 52 785

(51) Int. Cl.[7] ..... F23Q 7/00

(52) U.S. Cl. ..... 313/118; 313/143; 313/144; 313/137; 123/145 A; 123/145 R

(58) Field of Search ..... 313/118, 138, 313/141, 143, 144, 137; 123/143 R, 145 A, 145 R

(56) References Cited

U.S. PATENT DOCUMENTS

| | | | | | |
|---|---|---|---|---|---|
| 4,418,661 | A | * | 12/1983 | Esper et al. | 123/145 R |
| 4,931,619 | A | * | 6/1990 | Ogata et al. | 123/145 A |
| 5,304,778 | A | * | 4/1994 | Dasgupta et al. | 123/145 A |
| 6,248,980 | B1 | * | 6/2001 | Chiu et al. | 123/145 A |

FOREIGN PATENT DOCUMENTS

| | | |
|---|---|---|
| DE | 31 46 653 | 10/1982 |
| DE | 38 17 843 | 12/1988 |
| DE | 3 837 128 | 5/1989 |

* cited by examiner

*Primary Examiner*—Ashok Patel
(74) *Attorney, Agent, or Firm*—Kenyon & Kenyon

(57) ABSTRACT

A ceramic sheathed element glow plug has a tubular metal casing holding a ceramic U-shaped heating device cantilevered at its end facing the combustion chamber, and on the end remote from the combustion chamber, it has a terminal pin for applying a voltage to the ceramic heating device. In the metal casing, a ceramic bushing and a ring follow the ceramic heating device at the end remote from the combustion chamber.

6 Claims, 1 Drawing Sheet

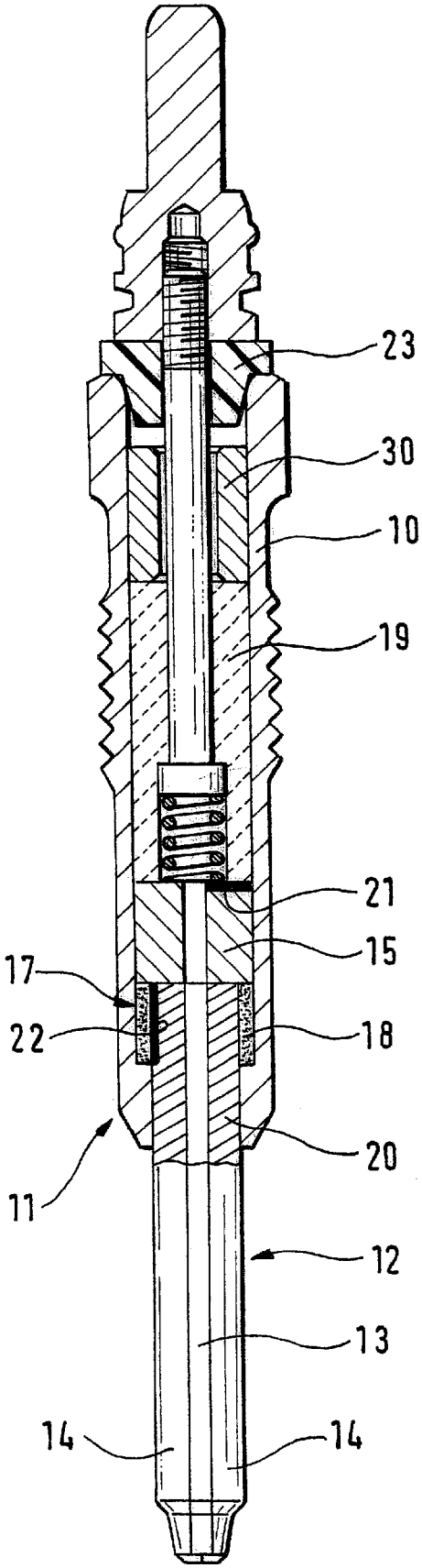
23
30
10
19
21
15
17
22
18
20
11
12
13
14
14

CERAMIC SHEATHED-TYPE GLOW PLUG

FIELD OF THE INVENTION

The present invention relates to a ceramic sheathed element glow plug for diesel engines. Such a sheathed element glow plug is already described in German Patent 3 837 128, where a ceramic heating device is held by the tip of a cylindrical holder. The ceramic heating device is thus electrically insulated with respect to the holder. A terminal device contacting the power supply voltage is provided on the side of the cylindrical holder opposite the ceramic heating device. The ceramic heating device includes a U-shaped heating section, with the two ends of the U-shaped heating section contacting the terminal device by wires or terminals sintered in place. During glow operation, a voltage is applied to the ceramic heating device, so that a current flows from one end of the U-shaped heating section over the tip of the heating section facing the combustion chamber to the other end of the U-shaped heating section. Because of the resistance of the ceramic, the current causes the heating section to heat up so that it glows, and the fuel-air mixture for ignition is heated.

SUMMARY OF THE INVENTION

The ceramic sheathed element glow plug according to the present invention has the advantage that by inserting a ceramic bushing and a ring into the plug casing, the latter is filled and is thus more stable, and in assembly of the sheathed element glow plug, a sealing compound provided between the end of the plug casing remote from the combustion chamber and the ceramic heating device can be compressed well. The pressure applied from the opening remote from the combustion chamber is transferred well over the ring and the ceramic bushing to the ceramic heating device, guaranteeing the desired seating of the ceramic heating device in the metal casing. Production is ultimately simplified and therefore is less expensive.

It is especially advantageous that first a ceramic bushing is arranged in the plug casing following the ceramic heating device. Good insulation of the inner conductor arrangement which passes centrally through the ceramic bushing is thus provided at the same time. Moreover, the ceramic bushing may sit directly on the ceramic heating device. Use of a ring such as a metal ring which is not sensitive to shock has the advantage that point pressure applied to the metal ring in assembly of the sheathed element glow plug is distributed well over the metal ring on the entire surface area of the ceramic bushing and the end face of the ceramic heating device remote from the combustion chamber. Due to the two-dimensional distribution of the applied compression pressure, the stress load on the ceramic is minimized.

BRIEF DESCRIPTION OF THE DRAWINGS

The figure shows a sheathed element glow plug according to the present invention.

DETAILED DESCRIPTION

The figure shows a longitudinal section through a ceramic sheathed element glow plug. The sheathed element glow plug has a cylindrical tubular metal casing which is plug casing 10. On two electrically conducting composite ceramic layers 14. Both electrically conducting composite ceramic layers 14 are joined by a thin web of electrically conducting composite ceramic at the tip of the ceramic heating device, so that electrically conducting composite ceramic layers 14 are arranged essentially in a U shape.

Ceramic heating device 12, also known as a glow plug, has an area with a larger diameter 15 in its rear section surrounded by cylindrical plug casing 10. The diameter of this rear section of the glow plug is selected so that the glow plug is displaceable in casing 10 in assembly of the sheathed element glow plug. The glow plug or ceramic heating device 12 is mounted in cylindrical plug casing 10 in such a way as to form a cavity 17 between the inside wall of tubular metal casing 11 and the outside wall of ceramic heating device 12 in the area of the smaller diameter, and this cavity is filled with an electrically conducting compressible material 18. This electrically conducting material 18 may be, for example, graphite, a metal powder, a powder mixture of ceramic and conductive particles or a graphite film-wound hollow cylinder.

The glow plug is coated with an insulating layer 20 produced by vitrification at least in the area where it is surrounded by plug casing 10. The area where this insulating layer 20 is applied is shown as a hatched area in this figure to facilitate identification. A first and a second recess 21 and 22 are provided in insulating layer 20 for contacting the electrically conducting composite ceramic layers. First recess 21 is provided on the end face of the glow plug remote from the combustion chamber in such a way that the terminal pin comes into contact with one leg of the U-shaped electrically conducting ceramic. The second electric contact is provided on the lateral outside wall of the second leg of the U-shaped electrically conducting ceramic. This second recess 22 is contacted with the plug casing by way of sealing compound 18, as shown in the figure. The recesses are indicated as a dark area in the figure.

In assembly of the sheathed element glow plug, first an electrically conducting sealing material 18 is introduced as a preformed molding into plug casing 10 from the opening remote from the combustion chamber. Then ceramic heating device 12 is inserted. First a ceramic bushing 19 and then a metal ring 30 follow ceramic heating device 12 in plug casing 10 at the end remote from the combustion chamber. After these individual elements have been inserted into the tubular metal casing, the glow plug is pushed by the action of force into end 11 of the plug casing facing the combustion chamber, and sealing material 18 is compressed in the process. During the compression process, the volume of cavity 17 is reduced. Then the casing is sealed by a sealing ring 23, with the terminal pin of the inner conductor arrangement passing through a central opening in the sealing ring. After a final adjustment of a defined pressing force, the ring can be secured by a form-fitting, force-locked or bonded connection produced by caulking, welding, screwing, soldering or gluing or by press bonding.

What is claimed is:

1. A ceramic sheathed element glow plug comprising:

a tubular metal casing;

a ceramic U-shaped heating device being held by the tubular metal casing and being in the form of a glow plug cantilevered at an end facing a combustion chamber;

a terminal pin situated on a side remote from the combustion chamber;

at least one insulating bushing situated adjacent to the ceramic heating device in the tubular metal casing;

a ring situated adjacent to the at least one insulating bushing; and an inner conductor arrangement electrically connecting the terminal pin with the ceramic heating device, the inner conductor arrangement passing through the at least one insulating bushing and the ring.

2. The glow plug according to claim 1, wherein the at least one insulating bushing is a ceramic bushing.

3. The glow plug according to claim 1, wherein the ring is composed of a material which is not sensitive to shock.

4. The glow plug according to claim 3, wherein the ring is composed of a metal, the ring having an inside opening having a diameter such that an inside wall of the ring is spaced from the inner conductor arrangement.

5. The glow plug according to claim 4, further comprising a dielectric situated between the inside wall of the ring and the inner conductor arrangement.

6. The glow plug according to claim 5, wherein the dielectric is an air gap.

* * * * *

UNITED STATES PATENT AND TRADEMARK OFFICE

CERTIFICATE OF CORRECTION

PATENT NO. : 6,437,492 B1
DATED : August 20, 2002
INVENTOR(S) : Albrecht Geissinger et al.

It is certified that error appears in the above-identified patent and that said Letters Patent is hereby corrected as shown below:

Column 1,
Line 2, change "FIELD OF THE INVENTION" to -- BACKGROUND INFORMATION --
Line 5, change "Such a sheathed element glow plug is already described in" to -- A sheathed element glow plug is described in --

Signed and Sealed this

Twenty-third Day of March, 2004

JON W. DUDAS
*Acting Director of the United States Patent and Trademark Office*